United States Patent [19]

Wilson

[11] 3,952,720

[45] Apr. 27, 1976

[54] BOWSTRING RELEASE MECHANISM

[76] Inventor: Hugh R. Wilson, 10840 SW. 120th St., Miami, Fla. 33176

[22] Filed: Apr. 11, 1975

[21] Appl. No.: 567,056

[52] U.S. Cl. ..... 124/35 A
[51] Int. Cl.[2] ..... F41B 5/00
[58] Field of Search ..... 124/35 A, 41 R, 30 R

[56] References Cited

UNITED STATES PATENTS

| | | | |
|---|---|---|---|
| 2,982,279 | 5/1961 | Pursley | 124/35 A |
| 3,009,454 | 11/1961 | Graham | 124/35 A |
| 3,800,774 | 4/1974 | Troncoso | 124/35 A |

*Primary Examiner*—Richard C. Pinkham
*Assistant Examiner*—William R. Browne

[57] ABSTRACT

This invention is that of a Bowstring Release Mechanism that is used in Archery for drawing the bowstring back and then releasing same to propel the arrow in its flight to the target. The mechanism is released by the use of a trigger, which is adjustable, and features a sear that aids in reducing applied force, resulting in an easier trigger pull. It includes the use of a flexible rope loop that is looped around the bowstring and held by a rotary holding member, which is locked by a sear. The sear is locked by a sliding trigger, which, when actuated, will free the sear and the holding member, allowing the loop to escape. The bowstring is then freed to propel the arrow.

2 Claims, 10 Drawing Figures

BOWSTRING RELEASE MECHANISM

FIELD OF THE INVENTION

This invention is directed to an archery bowstring draw and release mechanism which is very easy to use. The mechanism can be operated by the same hand that holds it, and offers the archer a more precise control of the releasing of the bowstring.

DESCRIPTION OF THE PRIOR ART

Although many releases have appeared in the past, many of them homemade, most of them have been simple devices that were often slow to use and only gave limited control over the act of releasing the bowstring.

A common fault is in the premature releasing of the bowstring before the archer was actually ready to do so. Another problem has been that of the release device slipping from the bowstring when under pressure.

This invention provides a new and reliable release device which is light in weight, easy to attach to the bowstring and which cannot slip off of the bowstring, that can be used in either the right hand or the left hand, has a trigger which can be pulled with little effort, even when used with heavy bows, and includes a trigger that is adjustable, which allows the user to adjust the pull of the trigger to suit his individual taste and temperment.

REFERENCE

Reference is made to a pending application Ser. No. 539,709, filed on Jan. 9, 1975, by the inventor herein.

SUMMARY OF THE INVENTION

It is the principal object of this invention to provide a bowstring release device that is precise in its construction, handy and easy to use for most people, but yet relatively simple in construction.

A further object of this invention is to provide the simple and easy use of the rotary holding member, which can be moved to its positions with the tip of the thumb.

Another object of this invention is the provision of the continuously adjustable trigger, which gives the archery enthusiast the ability to adjust the trigger to a position which can give him a more infinite control over the act of releasing the bowstring and therefore more infinite control over the accuracy of his efforts. The novelty of this invention will become more apparent in the specification and claims.

A BRIEF DESCRIPTION OF THE DRAWINGS

DESCRIPTION OF THE PREFERRED EMBODIMENT

Figure 1:
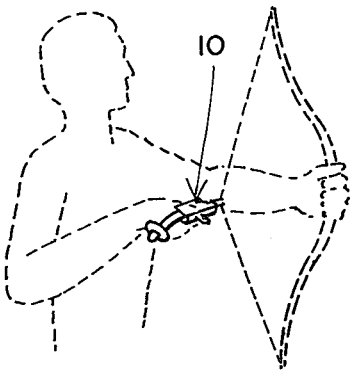
FIG. 1 shows an archer using a conventional bow and illustrates the manner in which the release device is held in the hand and used.
Figure 8:
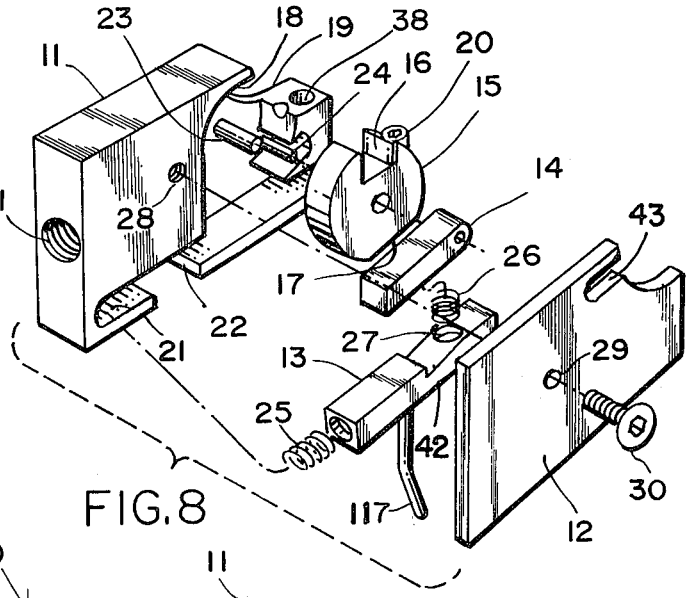
FIG. 8 is an exploded view of the component parts of the mechanism and the housing.
Figure 2:
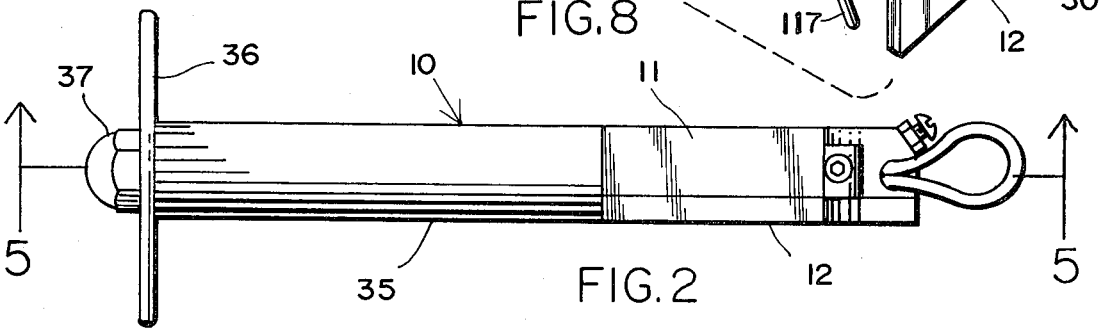
FIG. 2 shows one side of the invention with the holding member and loop and handle.
Figure 3:
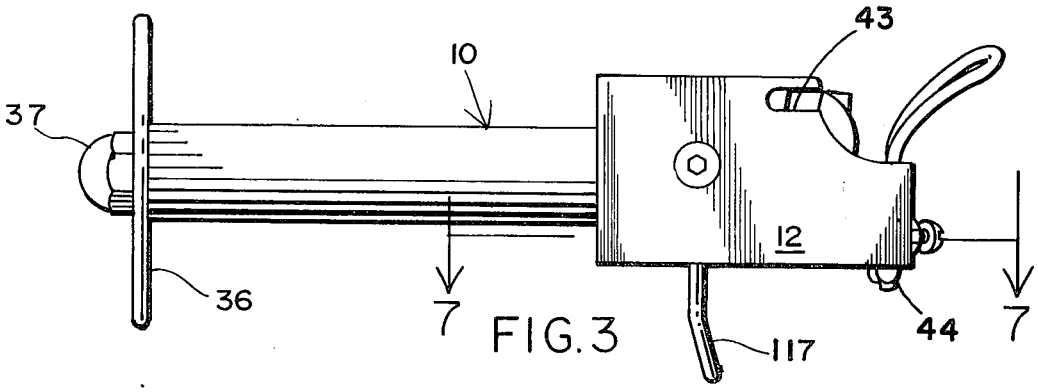
FIG. 3 shows the top view of the invention.
Figure 4:
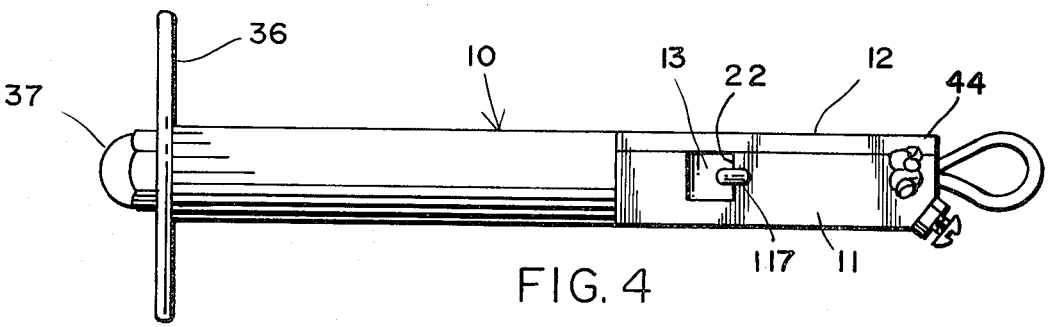
FIG. 4 shows a view of the other side with the trigger lever, rope loop and handle visible.

Referring to the drawings by characters of reference, FIGS. 1–8 illustrate a bowstring draw and release device comprising a handle 10 and a housing 11.

The handle 10, which is elongated and cylindrical in shape, is attached to the housing 11 by a threaded yoke 32. A length of metal chain 34 is secured to the threaded yoke 32 by a retaining pin 33. A second threaded yoke 32 is attached to the other end of the chain by a retaining pin 33 in the same manner. A flexible tubing cover 35 covers the chain and threaded yokes to provide a smooth gripping surface for the hand. The flexible tube 35 is retained by a disc 36 and a threaded nut 37 secured on the second threaded yoke 32. The purpose of the disc 36 is to prevent the hand from sliding from the handle while the user is drawing back the bowstring. The handle 10 is attached to the housing 11 by use of hole 31.

Figure 9:
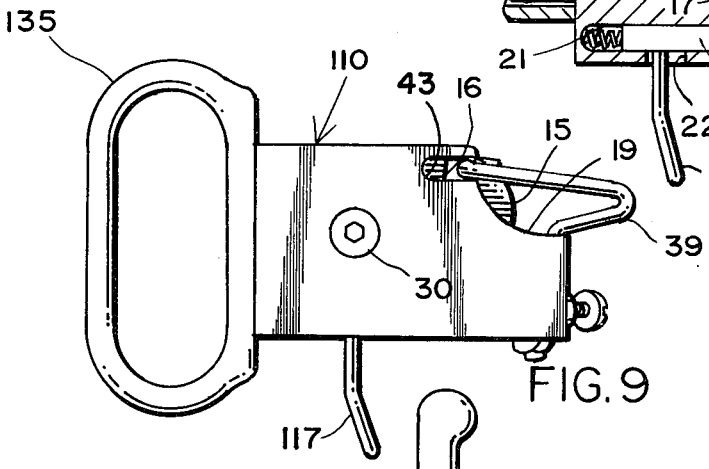
FIG. 9 shows an alternate type of handle that is contemplated.
Figure 10:
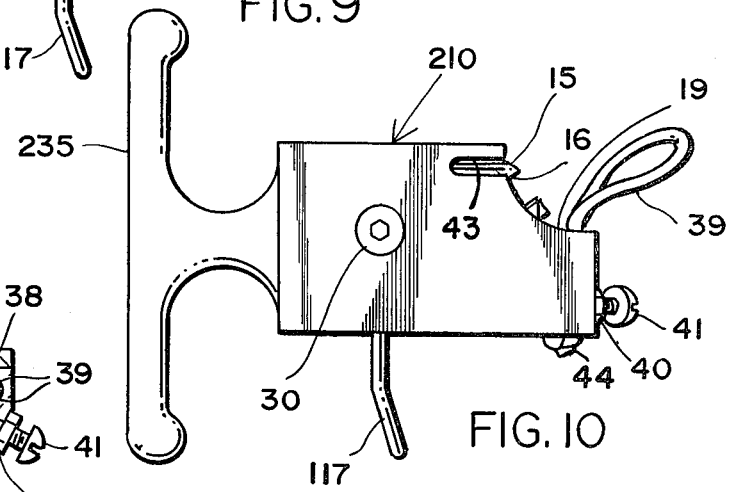
FIG. 10 shows a T-shaped handle which can also be used with the mechanism.

In FIGS. 9–10 alternate handle forms are shown. In FIG. 9, the stirrup-type handle 135 is a part of the housing 110 and is gripped by the three middle fingers of the hand, the trigger 117 is actuated by the little finger of the user's hand.

The T-shaped handle 235 shown in FIG. 10 is an extension of housing 210 and is meant to be gripped by three fingers of the hand with the trigger 117 being actuated by the little finger of the user's hand.

The housing or body portion 11 is rectangular in shape and is fabricated from a suitable metal such as aluminum alloy of high tensile strength. The housing portion also comprises the cover 12.

The housing 11 is provided with a cavity 18. The rounded part of cavity 18 contains the holding member 15, which rotates within the cavity 18 on pin 23. The sear member 14 is contained within the cavity 18 and pivots on pin 24, which passes through one end of the sear member 14. Pivot pin 23 and pivot pin 24 are pressed tightly into blind-bottom holes that are drilled in the housing 11 for this purpose.

Trigger member 13 is contained within the slotted extension 21 of cavity 18 and slides from its first position to its second position within said slotted extension 21 of cavity 18.

The compression spring 25 installed in the end of trigger member 13 bears against the housing 11 and returns the trigger member 13 to its first position after the trigger member 13 has been actuated to its second position.

The trigger member 13 is fabricated of steel and is finely polished to avoid excessive friction, and is sufficiently long enough to insure that it will not bind in the slotted cavity extension 21. The trigger member is rectangular in cross section to conform to the slotted extension 21 of cavity 18, and has an angular notch 42 cut from its surface to allow clearance for the movement of sear member 14 when sear member 14 moves to its second position.

A retaining hole is drilled in the surface of angular notch 42 in trigger member 13 to retain the compression spring 26. The compression spring 26 provides biasing means to sear member 14 to return the sear member 14 to its first position after having moved to its second position.

Trigger member 13 is fabricated with a finger lever 117 to be gripped by the finger of the user's hand. The movement of finger lever 117 provides movement of the trigger member 13 to first and second positions, respectively.

The opening 22 in the housing cavity slot 21 allows the finger lever 117 to protrude from the housing 11 where it is gripped by the finger of the user.

The cover plate 12 of a shape conforming to that of housing 11 is fitted to the top surface of the housing 11 and is secured by socket head screw 30 which passes through hole 29 of cover 12 and into the threaded hole 28 in the housing 11.

The holding member 15 is fitted with a socket head cap screw 20 on its circumference to act as a stop and to limit the rotation of the holding member 15 when it rotates from its first position to its second position and when it is moved manually from its second position to its first position.

The holding member 15 has an escape notch 16 cut from its circumference for the purpose of holding the rope loop member 39 in its first position. The surface of escape notch 16 that contacts the rope loop member 39 is smoothly rounded so as not to chafe the rope member 39.

The rope loop member 39 is inserted through the hole 38 that is drilled through the front portion of the housing 11. The rope loop member 39 is secured from pulling through hole 38 when under tension, by the knots 44 tied in the two ends of the rope loop member 39.

The milled slot 43 in housing 11 and the slot 43 in cover plate 12 are to provide clearance for rope loop 39 when contained in escape notch 16 of the holding member 15 when the holding member 15 and the rope loop 39 are locked in the first position.

The flat surface 17 of holding member 15 bears against sear member 14 and prevents holding member 15 from rotating when the mechanism is in the first position.

Figure 7:
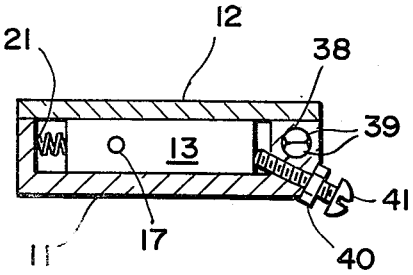
FIG. 7 shows the cut-away trigger side of the housing with the trigger adjusting screw shown and its relation to the trigger.

The screw 41 in FIG. 7 provides for the adjustment of the trigger member 13 by limiting or increasing the movement of trigger member 13. This novel feature allows the user to regulate the amount of movement of the trigger member 13 to suit his own requirements.

OPERATION OF THE DEVICE

Traditionally, the string of a bow is drawn back by the fingers of the hand. Archers have experienced problems such as sore or blistered fingers. This especially true during archery tournaments where many arrows must be shot to complete the tournament. Another problem arises for bowhunters in a cold climate where the fingers become numb with the cold.

With this invention, the handle is gripped in such a manner as to eliminate the above problems to a great degree. The adjustable trigger allows a bowhunter in a cold climate to increase the length of the pull on the trigger and to minimize the chances of a premature release of the arrow due to numb fingers.

Figure 5:
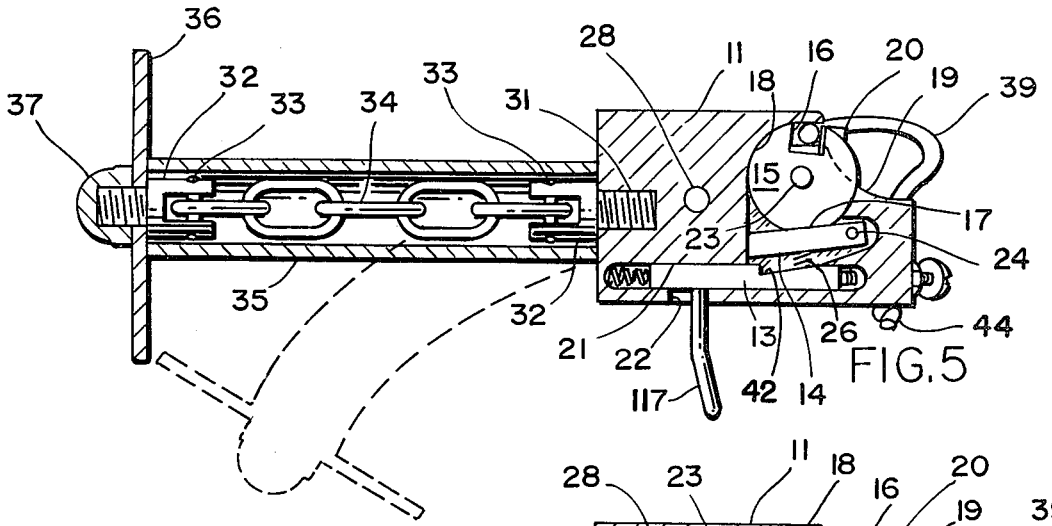
FIG. 5 shows the component parts of the mechanism in a first or locked position, the rope loop secured by the holding member, the construction of the handle, and in dash lines, the handle in a flexed position.

To attach the device to the bowstring, the rope loop 39 is passed around the bowstring and the closed end of the loop is pushed into the escape notch 16 of holding member 15. While holding the loop member 39 in this position with the thumb, the thumb is moved slightly forward to grip the head of the socket head screw 20. With the head of screw 20 so gripped, the end of the thumb is used to rotate the holding member 15 to the rear in a counter-clockwise direction until the rope loop 39 is carried into the milled slot 43 of the housing 11. FIG. 5. With the holding member 15 now in its first position, the sear member 14 pivots on pin 24 under pressure from spring 26 to its first position against the flat surface 17 of holding member 15. FIG. 5. With the sear member so pivoted to its first position, the trigger member 13 is now free to slide forward to its first position, engaging the surface of sear member 14 and locking sear member 14, holding member 15 and rope loop member 39 in the first positions, said trigger member 13 being held in the first position by spring 25. FIG. 5.

With the device now in first position and the rope member 39 attached to the bowstring, the archer may now draw the bowstring back to the desired position. When the user has the bow and arrow aligned with the target to his satisfaction, he pulls back on the trigger lever 117, causing the trigger member 13 to slide rearward to its second position.

Due to the unique design of the sear member 14, much of the force applied to the holding member 15 by the tension of the bowstring is absorbed by the pin 24, the remainder of said force being greatly diminished by the length of the sear member to the point of contact with trigger member 13. This feature permits an easy pulling trigger, even when the device is used with a very heavy bow.

With the trigger member 13 now in its second position, the sear member 14 is unlocked. The force exerted on holding member 15 by the tensed bowstring causes the holding member 15 to rotate in a clockwise direction, the flat surface 17 pushing against the sear member 14, causing the sear member 14 to pivot on pin 24 to the second position, clearance being provided by the angular notch 42 in trigger member 13.

Figure 6:
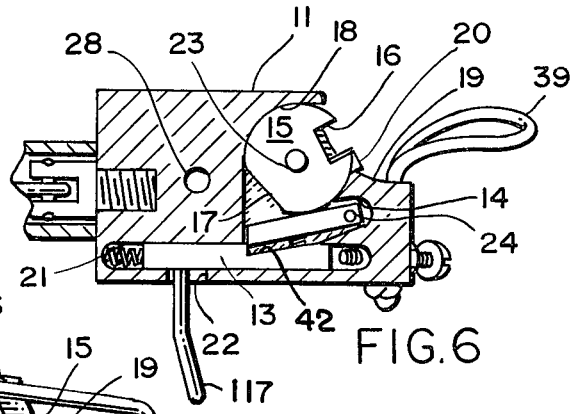
FIG. 6 shows the mechanism in the second position or unlocked position.

With the sear member 14 now in its second position, the holding member 15 is freed to rotate to its second position and allowing the rope loop member 39 to escape from the milled slot 43 in housing 11 and allowing the rope loop member to slip out of the escape notch 16 and thereby releasing the bowstring. FIG. 6. The bowstring so released now brushes the rope loop member 39 from its path and propels the arrow to the target, the bowstring then being in a relaxed position.

Although but a few embodiments of the invention have been shown and described, it will be apparent to those skilled in the art that various changes and modifications may be made therein without departing from the spirit of the invention or from the scope of the appended claims.

What is claimed is:

1. A bowstring holding and release mechanism comprising a holding and release means for releasably engaging a bowstring, said holding and release means comprising a rotating holding member for movement between first and second position for holding and releasing a bowstring, respectively, sear means engaging a first surface portion of said holding member to retain said holding member in said first position when said sear means is in a first pivoted position, trigger means engaging a first end portion of said sear means to retain said sear means in a first position, when said trigger means is in a first sliding position, said trigger means being slideable to a second position out of engagement with said end portion to permit said sear means to pivot to said second position out of engagement with said surface portion of said holding member to permit said holding member to rotate to said second position for releasing a bowstring, said holding member when manually moved to said first position being engaged by said sear means and said sear means being engaged by said trigger means, locking means for selectively holding said trigger means in first sliding position and said sear means in first pivoted position for retaining said holding member in said first position, said locking means including biasing means for automatically sliding the trigger means back to said first position after sliding of said trigger means from said first position to said second position and an additional means for automatically pivoting said sear means back to said first position after pivoting of said sear means from said first position to said second position, whereby said locking means holds said holding member when said trigger means and said sear means are in first positions and said bowstring is tensed and when said trigger means and said sear means move to said second position a bowstring moves to a released position.

2. A bowstring holding and release device comprising in combination:

a handle member adapted to be gripped by the human hand, holding and release means mounted on said handle for releasably engaging a bowstring, said holding and release means comprising a rotating holding member for movement between first and second position for holding and releasing a bowstring, respectively, sear means engaging a first surface portion of said holding member to retain said holding member in said first position when said sear member is in a first pivoted position, trigger means engaging a first end portion of said sear means to retain said sear means in a first position, when said trigger means is in a first sliding position, said trigger means being slideable to a second position out of engagement with said portion to permit said sear means to pivot to said second position out of engagement with said surface portion of said holding member to permit said holding member to rotate to said second position for releasing a bowstring, said holding member when manually moved to said first position being engaged by said sear means and said sear means being engaged by said trigger means, locking means for selectively holding said trigger means in first sliding position and said sear means in first pivoted position for retaining said holding member in said first position, said locking means including biasing means for automatically sliding the trigger means back to said first position after sliding of said trigger means from said first position to said second position and an additional means for automatically pivoting said sear means back to said first position after pivoting of said sear means from said first position to said second position, flexible rope means connected to said holding and release means and looped around a bowstring and over a second surface of said holding member, whereby said locking means holds said holding member and said rope means around said second surface of said holding member when said trigger means and said sear means are in first positions and said bowstring is tensed and when said trigger means and said sear means move to said second position said rope means slips off of said second surface of said holding member and from around a bowstring as a bowstring moves to a released position, trigger adjusting means limiting or increasing the engagement of said trigger means with said sear means.

* * * * *